US005894769A

United States Patent [19]

Rogers et al.

[11] Patent Number: 5,894,769

[45] Date of Patent: Apr. 20, 1999

[54] FRONT END ALIGNMENT TOOL

[76] Inventors: Irving F. Rogers, 8001 Mullet St., New Orleans, La. 70126; Raymond M. Cash, 1016 Green Acres Rd.; Charles M. Lunda, 5620 Camphor St., both of Metairie, La. 70003

[21] Appl. No.: 08/905,852

[22] Filed: Aug. 4, 1997

[51] Int. Cl.[6] ..... B25B 11/00

[52] U.S. Cl. ..... 81/484; 254/100

[58] Field of Search ..... 81/484, 9.24, 3.7, 81/485, 462, 180.1; 254/100

[56] References Cited

U.S. PATENT DOCUMENTS

| | | | |
|---|---|---|---|
| 591,164 | 10/1897 | Golar | 254/100 X |
| 829,344 | 8/1906 | Larsen | 254/100 |
| 1,117,662 | 11/1914 | Graham | 254/100 |
| 1,135,271 | 4/1915 | Edwards | 254/100 |
| 3,580,543 | 5/1971 | Hafeli | 254/100 |

*Primary Examiner*—D. S. Meislin
*Attorney, Agent, or Firm*—Michael I. Kroll

[57] ABSTRACT

A front end alignment tool (10) for a front suspension system (12) of a motor vehicle (14) comprising an elongate bolt (16). A foot (20) is also provided. A structure (22) is for attaching the foot (20) to a first end (24) of the elongate bolt (16). An assembly (26) is for mounting transversely and in an operable manner the elongate bolt (16) onto either end shaft (28) and (29) of a pivot bar (30), for an upper suspension arm (32) of the front suspension system (12). A component (38) on a second end (40) of the elongate bolt (16), is for rotating the elongate bolt (16), so that the foot (20) will bear against a frame (42) of the motor vehicle (14). This allows adjustment and tightening of a bolt (44) and nut (46) through each of two apertures (48) in the pivot bar (30) and each of two adjustment slots (50) in a suspension arm frame mount (52) of the front suspension system (12) attached to the frame (42) of the motor vehicle (14).

16 Claims, 2 Drawing Sheets

Fig. 2
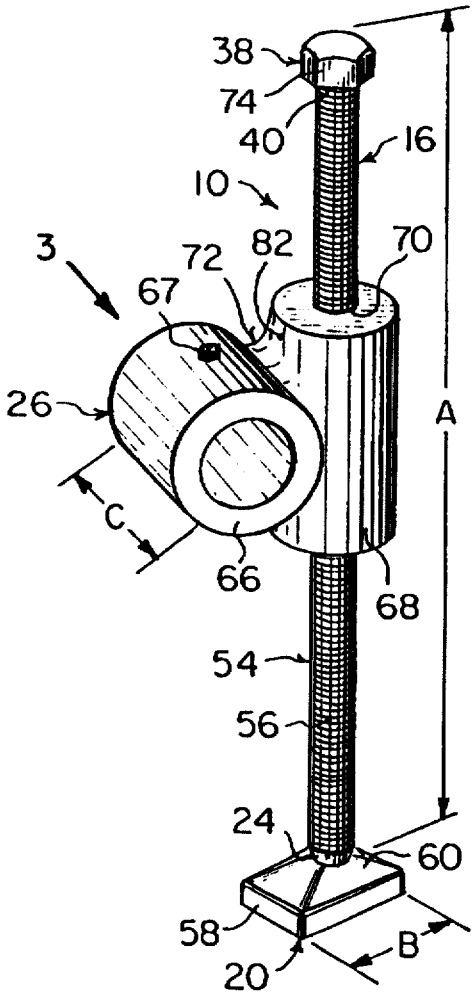
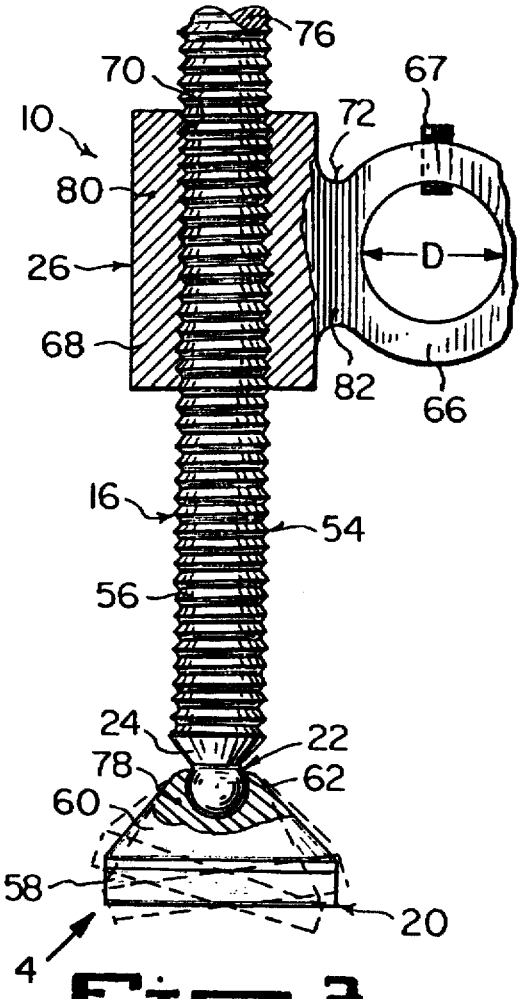
Fig. 3
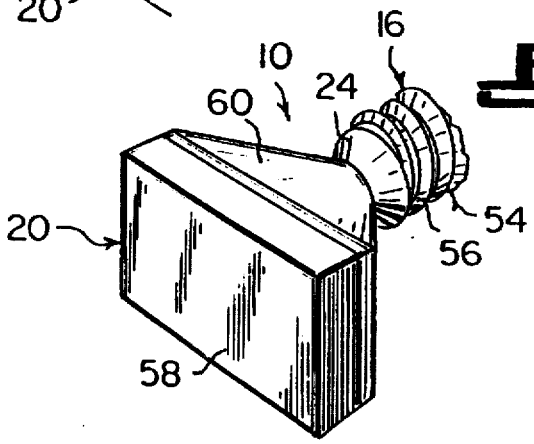
Fig. 4

FRONT END ALIGNMENT TOOL

BACKGROUND OF THE INVENTION

1. Field of the Invention

The instant invention relates generally to automotive accessories and more specifically it relates to a front end alignment tool. The front end alignment tool is used to adjust the camber and caster on the front end to exact specifications with little effort.

2. Description of the Prior Art

Numerous automotive accessories have been provided in prior art that are adapted to measure the alignment of front wheels on motor vehicles. While these units may be suitable for the particular purpose to which they address, they would not be as suitable for the purposes of the present invention as heretofore described.

SUMMARY OF THE INVENTION

A primary object of the present invention is to provide a front end alignment tool that will overcome the shortcomings of the prior art devices.

Another object is to provide a front end alignment tool that will enable a person to adjust the front end alignment to factory specifications without much trouble.

An additional object is to provide a front end alignment tool that can be attached in a removable manner to either end shaft of a pivot bar, to properly adjust an upper suspension arm, so that nuts and bolts in adjustment slots in a suspension arm frame mount can be tightened in place.

A further object is to provide a front end alignment tool that is simple and easy to use.

A still further object is to provide a front end alignment tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 2 is a perspective view of the instant invention per se.

FIG. 3 is an enlarged elevational view taken in the direction of arrow 3 in FIG. 2, with parts broken away and in section.

FIG. 4 is a further enlarged perspective view taken in the direction of arrow 4 in FIG. 3, showing the foot in greater detail.

Similar reference characters denote corresponding features consistently throughout the attached drawings.

DETAILED DESCRIPTION OF THE PREFERRED EMBODIMENTS

Figure 1:
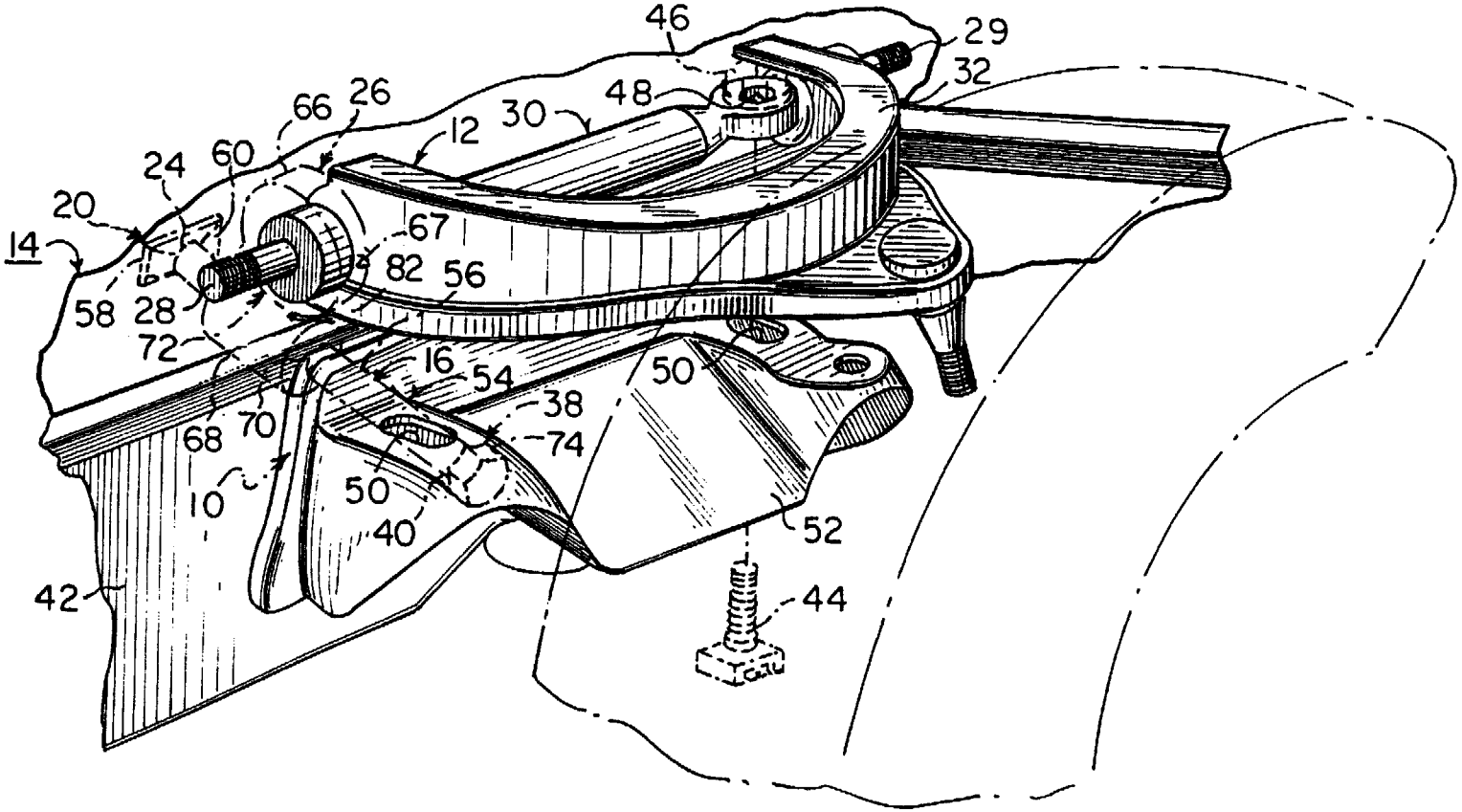
FIG. 1 is a perspective view showing the instant invention in phantom and in place ready to properly adjust the upper suspension arm.

Turning now descriptively to the drawings, in which similar reference characters denote similar elements throughout the several views, FIGS. 1 through 4 illustrate a front end alignment tool 10 for a front suspension system 12 of a motor vehicle 14, comprising an elongate bolt 16. A foot 20 is also provided. A structure 22 is for attaching the foot 20 to a first end 24 of the elongate bolt 16. An assembly 26 is for mounting transversely and in an operable manner the elongate bolt 16 onto either end shaft 28 and 29 of a pivot bar 30 for an upper suspension arm 32 of the front suspension system 12.

A component 38 on a second end 40 of the elongate bolt 16, is for rotating the elongate bolt 16, so that the foot 20 will bear against a frame 42 of the motor vehicle 14. This allows adjustment and tightening of a bolt 44 and nut 46 through each of two apertures 48 in the pivot bar 30 and each of two adjustment slots 50 in a suspension arm frame mount 52 of the front suspension system 12 attached to the frame 42 of the motor vehicle 14.

The elongate bolt 16 is a shank 54 having external threads 56 therealong. The foot 20 is a base pad 58, having a tapered top portion 60 extending to the first end 24 of the elongate bolt 16. The attaching structure 22, as shown in FIG. 3, is a swivel joint 62 between the foot 20 and the first end 24 of the elongate bolt 16, so that the foot 20 can be angularly adjusted with respect to the first end 24 of the elongate bolt 16.

The mounting assembly 26, consists of a collar 66 to fit onto either end shaft 28 and 29 of the pivot bar 30. A setscrew 67 is in the collar 66 to hold the collar 66 snugly on either end shaft 28 and 29 of the pivot bar 30. A sleeve 68 has an internally threaded bore 70, so that the elongate bolt 16 can be threaded through the internally threaded bore 70 of the sleeve 68. A facility 72 is for affixing the sleeve 68 transversely to one side of the collar 66.

The rotating component 38 is a hex head 74 on the second end 40 of the elongate bolt 16. A person can use a wrench to engage with the hex head 74, to rotate the elongate bolt 16 clockwise and counterclockwise.

The elongate bolt 16 is fabricated out of a strong durable metal material 76. The foot 20 is fabricated out of a strong durable metal material 78. The collar 66 and the sleeve 68 are both fabricated out of a strong durable metal material 80. The affixing facility 72 is a weld 82 made between the sleeve 68 and the collar 66.

The typical, but not limited thereto, dimensions for some of the parts of the front end alignment tool 10 are as follows:

A) Length of the elongate bolt 16 is 9½ inches.

B) Length of the foot 20 is ¾ of an inch.

C) Length of the collar 66 is 1½ inches.

D) Inside diameter of the collar 66 is 1⅛ inches.

OPERATION OF THE INVENTION

To use the front end alignment tool 10, the following steps should be taken:

1. Slip the collar 66 of the mounting assembly 26 of a first front end alignment tool 10 onto the first end shaft 28 of the pivot bar 30.
2. Tighten the setscrew 67 in the collar 66 of the first front end alignment tool 10, when the foot 20 faces the frame 42 of the motor vehicle 14.
3. Slip the collar 66 of the mounting assembly 26 of a second front end alignment tool 10 onto the second end shaft 29 of the pivot bar 30.

4. Tighten the setscrew 67 in the collar 66 of the second front end alignment tool 10, when the foot 20 faces the frame 42 of the motor vehicle 14.
5. Turn in a first direction the elongate bolt 16 via the rotating component 38 of the first front end alignment tool 10, so that the foot 20 will bear against the frame 42 of the motor vehicle 14.
6. Turn in a first direction the elongate bolt 16 via the rotating component 38 of the second front end alignment tool 10, so that the foot 20 will also bear against the frame 42 of the motor vehicle 14 to properly adjust the pivot bar 30.
7. Tighten the nuts 46 on the bolts 44 that extend through the adjustment slots 50 in the suspension arm frame mount 52 and the apertures 48 in the pivot bar 30, to hold the pivot bar 30 in place.
8. Turn in an opposite direction the elongate bolt 16 via the rotating component 38 of the first front end alignment tool 10, so that the foot 20 will move away from the frame 42 of the motor vehicle 14.
9. Turn in an opposite direction the elongate bolt 16 via the rotating component 38 of the second front end alignment tool 10, so that the foot 20 will also move away from the frame 42 of the motor vehicle.
10. Loosen the setscrew 67 in the collar 66 of the first front end alignment tool 10.
11. Remove the collar 66 of the mounting assembly 26 of the first front end alignment tool 10 from the first end shaft 28 of the pivot bar 30.
12. Loosen the setscrew 67 in the collar 66 of the second front end alignment tool 10.
13. Remove the collar 66 of the mounting assembly 26 of the second front end alignment tool 10 from the second end shaft 29 of the pivot bar 30.

LIST OF REFERENCE NUMBERS

10 front end alignment tool
12 front suspension system of 14
14 motor vehicle
16 elongate bolt of 10
20 foot of 10 for 16
22 attaching structure for 20 on 24
24 first end of 16
26 mounting assembly for 16 on 28, 29
28 first end shaft of 30
29 second end shaft of 30
30 pivot bar for 32
32 upper suspension arm of 12
38 rotating component on 40 for 16
40 second end of 16
42 frame of 14
44 bolt of 12
46 nut of 12
48 aperture in 30
50 adjustment slot in 52
52 suspension arm frame mount of 12
54 shank of 16
56 external threads on 54
58 base pad for 20
60 tapered top portion of 58
62 swivel joint for 22
66 collar of 26
67 setscrew in 66
68 sleeve of 26
70 internally threaded bore in 68
72 affixing facility of 26
74 hex head for 38
76 strong durable metal material for 16
78 strong durable metal material for 20
80 strong durable metal material for 66 and 68
82 weld for 72

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A front end alignment tool for a front suspension system of a motor vehicle comprising:

a) an elongate bolt;

b) a foot;

c) means for attaching said foot to a first end of said elongate bolt;

d) means for mounting transversely and in an operable manner said elongate bolt onto either end shaft of a pivot bar for an upper suspension arm of the front suspension system, said mounting means including:

i) a collar to fit onto either end shaft of the pivot bar;

ii) a setscrew in said collar to hold said collar snugly on either end shaft of the pivot bar;

iii) a sleeve having an internally threaded bore, so that said elongate bolt can be threaded through said internally threaded bore of said sleeve; and iv) means for affixing said sleeve transversely to one side of said collar; and e) means on a second end of said elongate bolt, for rotating said elongate bolt, so that said foot will bear against a frame of the motor vehicle to allow adjustment and tightening of a bolt and nut through each of two apertures in the pivot bar and each of two adjustment slots in a suspension arm frame mount of the front suspension system attached to the frame of the motor vehicle.

2. A front end alignment tool as recited in claim 1, wherein said elongate bolt is a shank having external threads therealong.

3. A front end alignment tool as recited in claim 1, wherein said foot is a base pad having a tapered top portion extending to said first end of said elongate bolt.

4. A front end alignment tool as recited in claim 1, wherein said attaching means is a swivel joint between said foot and said first end of said elongate bolt, so that said foot can be angularly adjusted with respect to said first end of said elongate bolt.

5. A front end alignment tool as recited in claim 1, wherein said rotating means is a hex head on said second end of said elongate bolt, so that a person can use a wrench to engage with said hex head to rotate said elongate bolt clockwise and counterclockwise.

6. A front end alignment tool as recited in claim 1, wherein each said elongate bolt is fabricated out of a strong durable metal material.

7. A front end alignment tool as recited in 1, wherein said foot is fabricated out of a strong durable metal material.

8. A front end alignment tool as recited in 1, wherein said collar and said sleeve are both fabricated out of a strong durable metal material.

9. A front end alignment tool as recited in claim 8, wherein said affixing means is a weld made between said sleeve and said collar.

10. A front end alignment tool as recited in claim 2, wherein said foot is a base pad having a tapered top portion extending to said first end of one said elongate bolt.

11. A front end alignment tool as recited in claim 10, wherein said attaching means is a swivel joint between said foot and said first end of said elongate bolt, so that said foot can be angularly adjusted with respect to said first end of said elongate bolt.

12. A front end alignment tool as recited in claim 11, wherein said rotating means is a hex head on said second end of said elongate bolt, so that a person can use a wrench to engage with said hex head to rotate said elongate bolt clockwise and counterclockwise.

13. A front end alignment tool as recited in claim 12, wherein each said elongate bolt is fabricated out of a strong durable metal material.

14. A front end alignment tool as recited in claim 13, wherein said foot is fabricated out of a strong durable metal material.

15. A front end alignment tool as recited in 14, wherein said collar and said sleeve are both fabricated out of a strong durable metal material.

16. A front end alignment tool as recited in claim 15, wherein said affixing means is a weld made between said sleeve and said collar.

* * * * *